United States Patent [19]

Pate et al.

[11] Patent Number: 4,662,069

[45] Date of Patent: May 5, 1987

[54] CUTTING TOOL HAVING PARALLEL CUTTING BLADES

[75] Inventors: Jim F. Pate, Box 622, Baird, Tex. 79504; Richard D. Guthrie, Baird, Tex.

[73] Assignee: Jim F. Pate, Baird, Tex.

[21] Appl. No.: 771,790

[22] Filed: Sep. 3, 1985

[51] Int. Cl.[4] ..... B26B 25/00

[52] U.S. Cl. ..... 30/273

[58] Field of Search ..... 30/264, 265, 273, 388, 30/306, 307

[56] References Cited

U.S. PATENT DOCUMENTS

| | | | |
|---|---|---|---|
| 702,788 | 6/1902 | Geczynski | 30/273 |
| 2,149,025 | 2/1939 | Marion | 30/273 |
| 3,157,948 | 11/1964 | Schwantz | 30/273 |
| 3,538,523 | 11/1970 | Sparks | 30/273 |
| 3,812,584 | 5/1974 | Peter | 30/273 |
| 4,244,102 | 1/1981 | Bolles | 30/273 |

*Primary Examiner*—Jimmy C. Peters

*Attorney, Agent, or Firm*—W. Kirk McCord

[57] ABSTRACT

A tool having parallel cutting blades for cutting matching seam edges from two pieces of material, such as two pieces of carpet. The tool is comprised of an insulative housing having a pair of rotatable cutting blades disposed on opposite sides thereof in substantially parallel relationship; an adjustable guide mechanism disposed adjacent to each of the cutting blades for holding the material to be cut in proper alignment with the cutting blades; and a base member on which the housing is mounted. An electric motor is disposed inside the housing for rotating the cutting blades via a worm gear mechanism. The guide mechanism preferably includes a spring-mounted shaft, which is adjustable in a vertical direction to provide the proper spacing between upper and lower members of the guide mechanism, in accordance with the thickness of the material to be cut. The spring allows the shaft to move upwardly against the spring tension in the event an area of irregular thickness in the material is encountered to provide smooth continuous cuts in the material.

16 Claims, 7 Drawing Figures

CUTTING TOOL HAVING PARALLEL CUTTING BLADES

FIELD OF THE INVENTION

The present invention relates generally to cutting tools and particularly to a tool having parallel cutting blades for cutting matching edges from two pieces of material, such as pieces of carpet, which are to be joined together to form a seam.

BACKGROUND OF THE INVENTION

Carpet materials are typically tufted, woven or bonded in wide widths and are cut to desired sizes and shapes for sale as area rugs. When the carpets are cut, a raw edge, which is referred to as the "selvage" edge is formed along the cut line. When carpet is being laid on the floor of a building, it is necessary to cut the carpet pieces to the desired sizes and shapes to fit the dimensions of the floor being covered. This process often necessitates joining two pieces of carpet along a straight line or "seam". In order to join the two pieces of carpet, the respective edges of the two materials to be joined must be cut to provide clean edges which are substantially parallel to one another.

DESCRIPTION OF THE PRIOR ART

According to prior practice, cutting tools such as a knife and T-square or a single rotary blade power tool is used to cut the seam edges for joining two pieces of carpet together. Typically, two pieces of carpet are aligned and the respective seam edges are cut in sequence, thereby requiring a two-step process to form the seam edges. An example of a single blade rotary carpet cutter is the carpet cutter manufactured and sold by Speed Cutter of Philadelphia, Pa. under the trademark "Speedbinder".

The aforementioned two-step process of cutting carpet seam edges is not only time consuming, but it is also difficult to cut parallel edges to facilitate joinder of the two edges. Another problem often encountered, particularly when a rotary blade cutting tool is used, is the problem of maintaining the pieces of carpet in the proper orientation with respect to the cutting blade. This is generally accomplished by using a guide mechanism, to sandwich the portion of the carpet being cut between upper and lower members of the guide mechanism to hold the carpet in the proper vertical position for efficient cutting. It is difficult to adjust the guide mechanism for the proper spacing between the upper and lower members, particularly when carpets having a non-uniform thickness are cut.

U.S. Pat. No. 4,244,102 discloses a carpet cutting machine having two rotary cutting blades mounted in substantially perpendicular planes for cutting a single piece of carpet into two sections with the cut edge of each section being beveled. The purpose of this type of tool is not to cut matching seam edges in order to join two pieces of carpet together, but rather to cut individual pieces of carpet from a large section thereof for sale to individual customers. The beveled edges facilitate handling of the individual pieces and protect against the carpet fibers becoming unravelled along the edges. The carpet cutting machine described in U.S. Pat. No. 4,244,102 would clearly not be suitable for cutting parallel seam edges for joining two pieces of carpet together.

OBJECTS OF THE INVENTION

It is therefore the principal object of the present invention to provide an improved tool for cutting matching seam edges for two pieces of material to be joined together, such as two pieces of floor carpet.

It is another object of the invention to provide a cutting tool to facilitate cutting two substantially parallel edges in respective two pieces of material, such as two pieces of floor carpet.

It is yet another object of the invention to provide an improved cutting tool for cutting carpet materials of non-uniform thicknesses.

It is a further object of the invention to provide a carpet cutting tool for maintaining the carpet material being cut in proper vertical and horizontal orientation with respect to the cutting blades for optimum cutting.

SUMMARY OF THE INVENTION

These and other objects are accomplished in accordance with the present invention wherein a tool for cutting materials such as carpet material and the like is comprised of a housing made from an electrically non-conductive material; a pair of rotatable cutting blades disposed at selected positions on respective opposite sides of said housing in substantially parallel relationship with one another; guide means attached to the housing adjacent to each of the cutting blades for maintaining the material to be cut in a selected position with respect to the cutting blades; and means for rotating the cutting blades at the desired speed for cutting.

In one embodiment the means for rotating the cutting blades is comprised of an electric motor having first rotatable shaft means coupled thereto; worm gear means attached to the first shaft means for being rotated along with the first shaft means when the motor is in operation; rotary gear means in mating engagement with the worm gear means for being rotated about an axis which is substantially orthogonal to the axis of rotation of the worm gear means; and second rotatable shaft means coupled to the cutting blades at respective opposite ends of the second rotatable shaft means and to the rotary gear means at a central portion of the second shaft means for imparting the rotation of the rotary gear means to the cutting blades. The cutting tool further includes handle means comprised of an electrically non-conductive material attached to the housing to facilitate manual operation of the tool by a user.

In another embodiment each of the guide means is comprised of first and second guide members, the second guide member being substantially in registration with the first guide member for receiving the material to be cut in an opening therebetween. The tool further includes adjustment means disposed on the housing adjacent to each of the cutting blades for adjusting the size of the opening between the first and second guide members in accordance with the thickness of the material to be cut.

In a preferred embodiment, the cutting tool is a tool for cutting carpet materials and includes a base member on which the housing is mounted and guide means for maintaining the carpet to be cut in a desired relationship with respect to the respective parallel cutting blades. Each of the guide means is comprised of first and second guide members spaced apart for receiving the carpet to be cut therebetween. Each of the second guide members is substantially in registration with the corresponding first guide member and cooperates with the cooresponding first guide member and cutting blade to provide a shear cutting action on the carpet to be cut. Means for adjusting the spacing between the corresponding first and second guide members in accordance with the thickness of the carpet to be cut is provided.

The adjustment means is comprised of a bit member which is movable along a vertical axis substantially orthogonal to the major plane of the base member. A first portion of the bit member is disposed within the housing and is coupled to the first guide member for moving the first guide member along the vertical axis and a second portion of the bit member is threaded and extends outwardly from the housing along the vertical axis. A spring member is disposed on the bit member within the housing for biasing the bit member and the first guide member towards the second guide member and for permitting the bit member and the first guide member to move against the bias of the spring member away from the second guide member, thereby allowing the spacing between the first and second guide members to be temporarily increased in response to variations in the thickness of the carpet being cut. A first threaded nut member is disposed on the second portion of the bit member for contacting an outer surface of the housing to limit the downward movement of the bit member and the first guide member towards the second guide member. A second threaded nut member is disposed above the first threaded nut member on the second portion of the bit member to lock the first nut member in position on the bit member.

BRIEF DESCRIPTION OF THE DRAWINGS

Still further objects and advantages of the invention will be apparent from the Detailed Description and Claims when read in conjunction with the accompanying drawings wherein:

DETAILED DESCRIPTION OF THE PREFERRED EMBODIMENTS

In the description which follows, like parts are marked throughout the specification and drawings, respectively. The drawings are not necessarily to scale and in some instances proportions may have been exaggerated in order to more clearly depict certain features of the invention.

Figure 1:
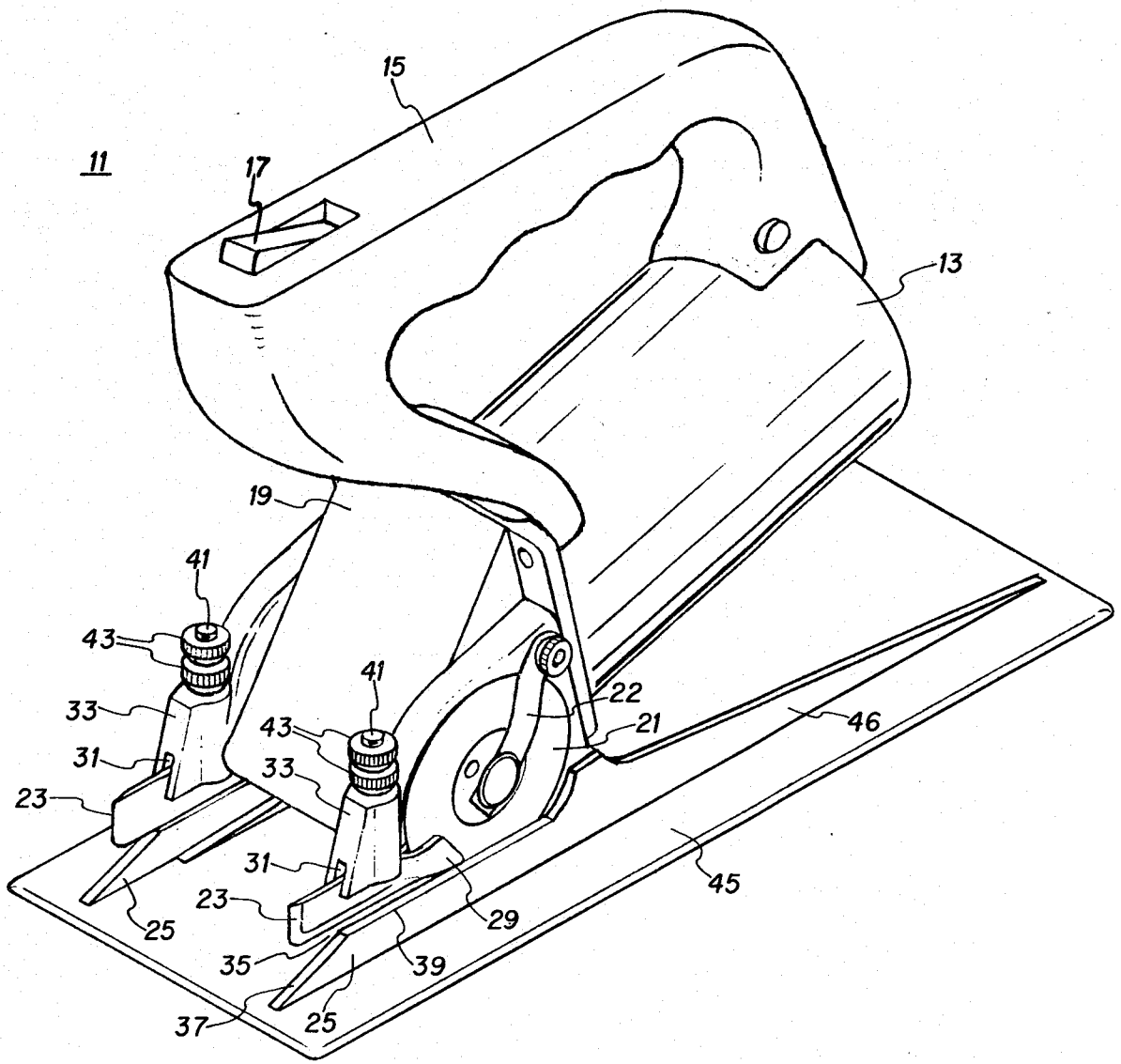
FIG. 1 is a perspective view of the cutting tool according to the present invention.
Figure 2:
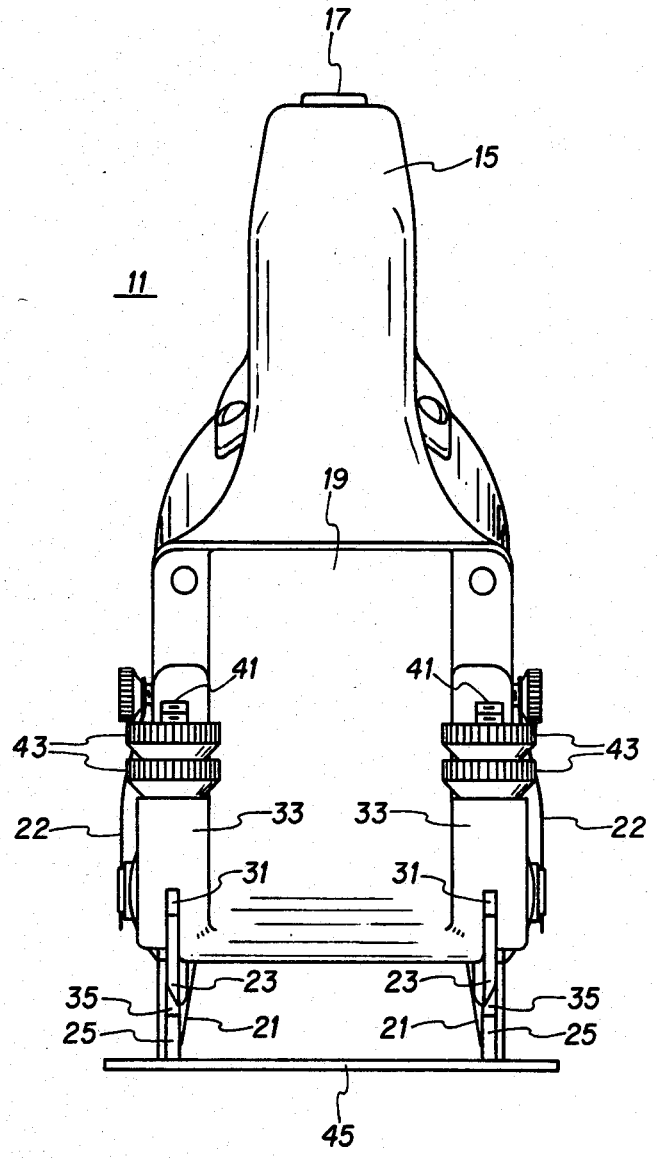
FIG. 2 is a front elevational view of the cutting tool according to the present invention.

Referring to FIGS. 1 and 2, a tool 11 for cutting carpet material and the like is powered by means of an electric motor (not shown) disposed within a motor housing 13. The electric motor is connected to a source of AC electrical power by means of a standard electrical cord (not shown). On the upper portion of tool 11 is a handle 15, which can be grasped by the user to facilitate manual operation of tool 11. An on-off switch 17 is disposed on the upper portion of handle 15 to selectively turn the electric motor on and off as desired.

Forward of motor housing 13 is a gear housing 19, which contains a gear mechanism for transferring the rotary motion of the electric motor to a pair of parallel cutting blades 21. The gear mechanism will be described in greater detail with reference to FIGS. 3 and 4. Cutting blades 21, only one of which is shown in FIG. 1, are disposed on respective opposite sides of gear housing 19 for being rotated about an axis connecting the two parallel cutting blades 21 at a desired speed for cutting. Each of the cutting blades 21 is retained axially by means of a retainer spring 22.

In front of and adjacent to each of cutting blades 21 is a guide mechanism comprised of first guide member 23 and second guide member 25. First guide member 23 is preferably comprised of an elongated, relatively flat member, the upper portion of which is received within an opening 31 within a housing 33 to allow first guide member 23 to be adjusted in a vertical direction within opening 31, as will be hereinafter described. The trailing edge of first guide member 23 is comprised of a pair of diverging projections 29, which form a forked member with an opening therebetween for receiving the front portion of the corresponding cutting blade 21. This arrangement provides protection and proper alignment for the corresponding cutting blade 21 and enhances the safety of operation of tool 11 by shielding the forward portion of cutting blade 21 while cutting blade 21 is in operation.

Second guide member 25 is substantially in registration with first guide member 23 and cooperates with first guide member 23 to provide an elongated channel 35 therebetween extending along the major axes of first guide member 23 and second guide member 25 for receiving the carpet material to be cut and for guiding the carpet toward the corresponding cutting blade 21. The forwardmost portion of second guide member 25 is comprised of an inclined portion 37 and a relatively flat portion 39, the upper edge of which is substantially parallel to the facing lower edge of first guide member 23. Inclined portion 37 serves to lift the carpet up and flat portion 39 cooperates with first guide member 23 to sandwich the carpet therebetween and maintain it in proper alignment with the corresponding cutting blade 21.

To allow for variations in the thickness of the carpet material being cut, an adjustment mechanism is provided for adjusting the spacing between first guide member 23 and second guide member 25. The adjustment mechanism includes an elongated bit member 41, a first portion of which is disposed within housing 33 and a second portion of which extends outwardly therefrom. The second portion of bit member 41 which extends outwardly from housing 33 is threaded for receiving a pair of threaded adjustment nuts 43. Adjustment nuts 43 are movable along the major axis of bit member 41 for contacting the upper surface of housing 33 to secure bit member 41 at a selected position, as will be described in greater detail with respect to FIGS. 3 and 4.

Tool 11 is mounted on a relatively flat base member 45 by means of second guide member 25. Second guide member 25 includes an elongated, rearwardly extending portion 46 to provide a stable mounting arrangement for tool 11 on base member 45.

Figure 3:
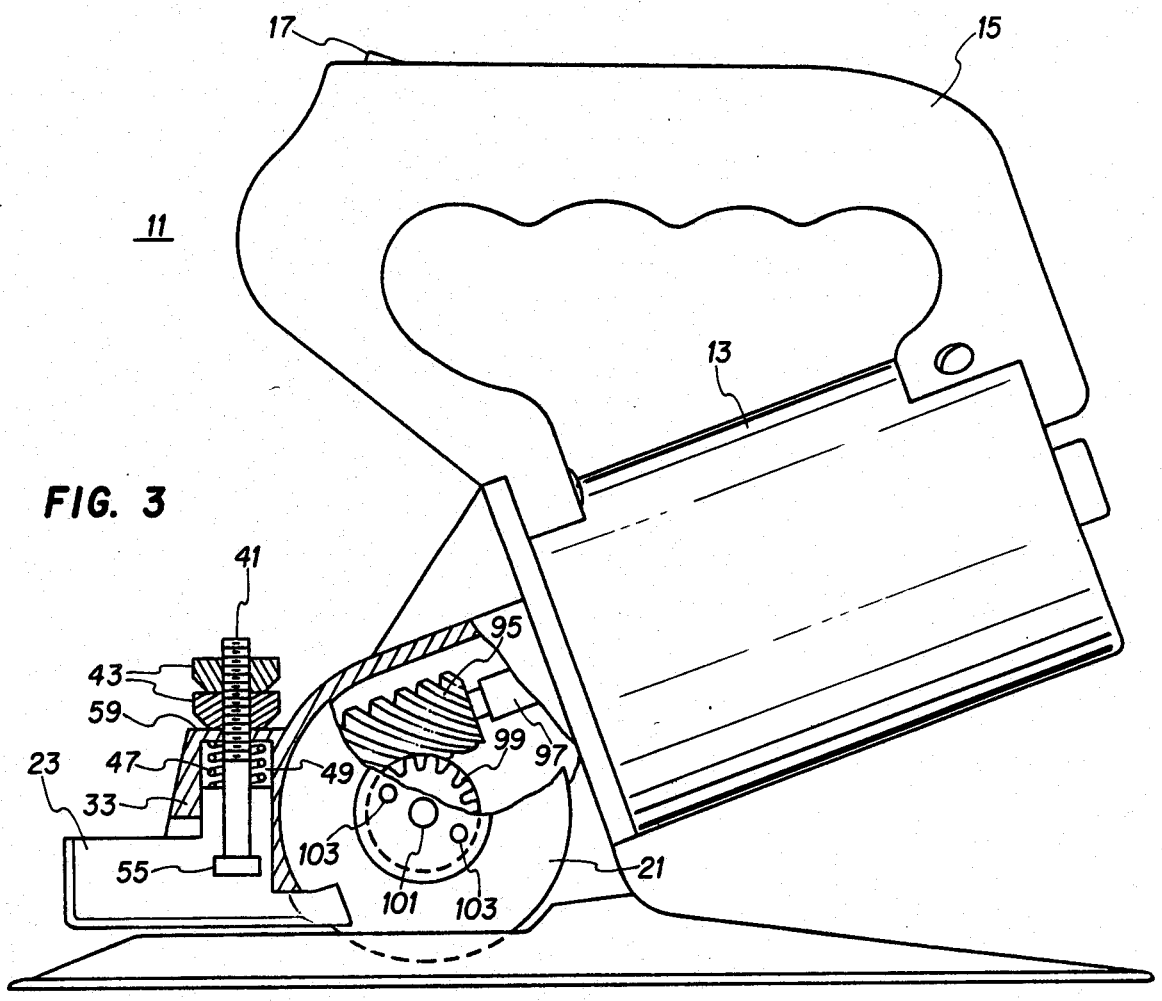
FIG. 3 is a sectional view of the cutting tool according to the present invention with a portion of the tool partially cut away to reveal the drive gear mechanism for the cutting blades and the adjustment mechanism for the guide members.

Referring to FIG. 3, a first embodiment of the mechanism for adjusting the spacing between first guide member 23 and second guide member 25 is depicted. Bit member 41 is spring-mounted by means of a spring member 47 within housing 33. Spring member 47 is disposed within a chamber 49 inside of housing 33 and is in contact at one end thereof with an inner surface of housing 33 and is in contact at the opposite end thereof with an upper surface of first guide member 23. Bit member 41 includes an end portion 55 of substantially greater width than the remaining portion of bit member 41. End portion 55 is received within a recessed chamber in first guide member 23 for coupling first guide member 23 to bit member 41 and housing 33, so that first guide member 23 moves substantially along with bit member 41. Housing 33 includes an elongated opening for receiving bit member 41. The opening is sized to provide a close tolerance between the inner surface of housing 33 and bit member 41 to maintain a true vertical alignment of bit member 41, while allowing bit member 41 to move freely in a vertical direction.

The spacing between first guide member 23 and second guide member 25 is adjusted as desired by raising or lowering bit member 41 until the spacing between first guide member 23 and second guide member 25 is such that the carpet material being cut fits snugly without binding between guide members 23 and 25. Adjustment nuts 43 are then rotated to move nuts 43 downwardly along bit member 41 until the lowermost one of adjustment nuts 43 contacts external surface 59 of housing 33, as shown in FIG. 3. Lower adjustment nut 43 is tightly secured against external surface 59 of housing 33 to prevent bit member 41 and first guide member 23 from further downward movement toward second guide member 25, when lower adjustment nut 43 contacts surface 59. Upper adjustment nut 43 locks lower adjustment nut 43 into place on bit member 41 to prevent lower adjustment nut 43 from being dislodged by vibration or the like. Spring member 47 tends to bias bit member 41 and first guide member 23 downwardly toward second guide member 25. Bit member 41 and first guide member 23 may be moved upwardly against the bias of spring member 47 and away from second guide member 25 to allow the spacing between guide members 23 and 25 to be temporarily increased in response to variatios in the thickness of the carpet being cut. For example, if the carpet is of irregular thickness or has rough spots therein, the areas of increased thickness of the carpet will exert an upward force on first guide member 23 to move it upwardly and away from second guide member 25, thereby preventing the carpet from becoming bound within channel 35 between guide members 23 and 25. One skilled in the art will readily see that the upward movement of first guide member 23 and bit member 41 is limited by the length of the chamber 49 in a vertical direction so that the upward movement of first guide member 23 and bit member 41 is arrested when the upper surface of first guide member 23 contacts the inner surface of housing 33 or when the downward bias of spring member 47 exceeds the upward force exerted on first guide member 23, whichever occurs first.

Figure 4:
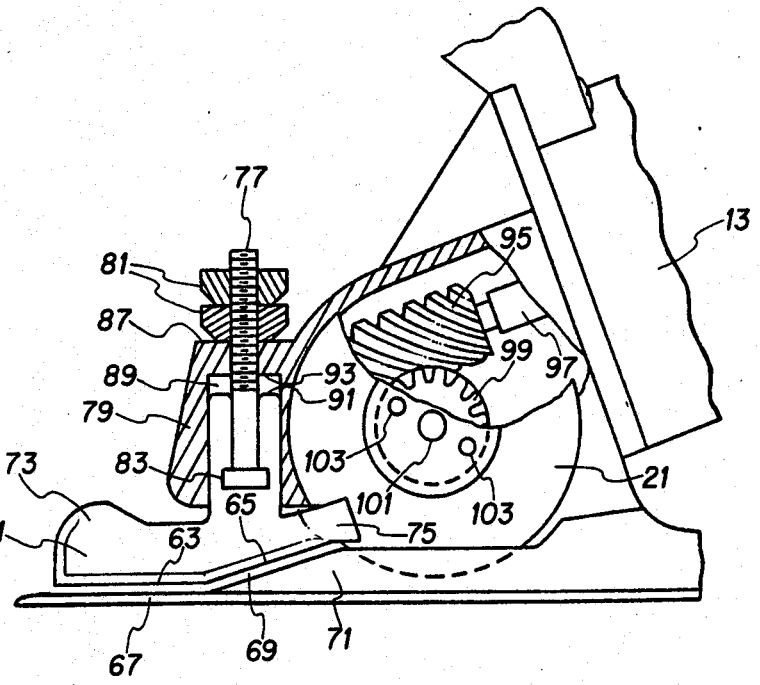
FIG. 4 is a sectional view of an alternate embodiment of the cutting tool according to the present invention with a portion of the tool cut away to reveal the drive mechanism and the adjustment mechanism for the guide members.

Referring to FIG. 4, an alternate embodiment of the cutting tool according to the present invention is depicted. The bottom edge of first guide member 61 is comprised of a horizontal portion 63 and an inclined portion 65 which are substantially parallel to respective horizontal portion 67 and inclined portion 69 of second guide member 71. First guide member 61 includes a raised portion 73 at the leading edge thereof and the trailing edge of first guide member 61 is comprised of a pair of diverging projection members 75 for receiving cutting blade 21 within an opening formed by projection members 75.

The spacing between first guide member 61 and second guide member 71 is varied by adjusting the position of an elongated bit member 77 along a vertical axis. Bit member 77 has a threaded portion for engaging a corresponding threaded portion within housing 79 so that the rotation of bit member 77 causes it to move vertically with respect to housing 79 in screw-like fashion. A portion of bit member 77 extends outwardly from housing 79 and has a pair of threaded adjustment nuts 81 disposed thereon for mating with the corresponding threaded portion of bit member 77. Bit member 77 includes an end portion 83 of substantially greater width than the remainder of bit member 77. End portion 83 is received within a recessed chamber in first guide member 61 for coupling first guide member 61 to bit member 77 and housing 79.

Bit member 77 is adjusted by rotating adjustment nuts 81 counter-clockwise (when viewed from above) so that adjustment nuts 81 move away from external surface 87 of housing 79 and upwardly along bit member 77. Adjustment nuts 81 and bit member 77 are then rotated together in the desired direction to move bit member 77 and first guide member 61 vertically to achieve the desired spacing between first guide member 61 and second guide member 71. To move bit member 77 and first guide member 61 downward so as to decrease the spacing between first guide member 61 and second guide member 71, adjustment nuts 81 and bit member 77 are rotated in a clockwise direction (when viewed from above). To move bit member 77 and first guide member 61 upwardly so as to increase the spacing between first guide member 61 and second guide member 71, adjustment nuts 81 and bit member 77 are rotated in a counter-clockwise direction (when viewed from above). When bit member 77 is in the desired position, adjustment nuts 81 are rotated clockwise so as to move downward along bit member 77 until the lowermost one of adjustment nuts 81 contacts external surface 87 of housing 79, as shown in FIG. 4. Upper adjustment nut 81 locks lower adjustment nut 81 into place on bit member 77 to prevent lower adjustment nut 81 from being dislodged due to vibration or the like. Housing 79 includes a chamber 89 for receiving a portion of bit member 77 and first guide member 61. One skilled in the art will readily see that the upward movement of bit member 77 and first guide member 61 is limited by the length of chamber 89 in a vertical direction and the upward movement of first guide member 61 is arrested when upper surface 91 of first guide member 61 contacts inner surface 93 of housing 79.

Referring to FIGS. 3 and 4, a portion of the drive mechanism for cutting blades 21 is depicted. The rotation of the electric motor (not shown) in motor housing 13 rotates a worm gear 95 attached to motor shaft 97. Worm gear 95 is in mating engagement with the gear teeth of a rotary gear 99, which is coupled to a drive shaft 101, the major axis of which is substantially orthogonal to the major axis of motor shaft 97. Worm gear 95 is preferably comprised of a ½ inch diameter gear with six helical gear teeth and rotary gear 99 is preferably comprised of a 1-inch diameter gear with 15 teeth. The gear reduction between worm gear 95 and rotary gear 99 is 15:1 so that the speed of rotation of drive shaft 101 is approximately 1,000 RPM as compared to the speed of rotation of motor shaft 95, which is approximately 15,000 RPM. Drive shaft 101 is comprised of two shafts which are connected to rotary gear 99 at respective adjacent ends thereof and to respective ones of cutting blades 21 at opposite ends thereof. A pair of lock lugs 103 couples each of the cutting blades 21 to rotary gear 99 for transferring the torque from drive shaft 101 to the respective cutting blades 21 to rotate cutting blades 21 at substantially the same speed as that of drive shaft 101.

Figure 5:
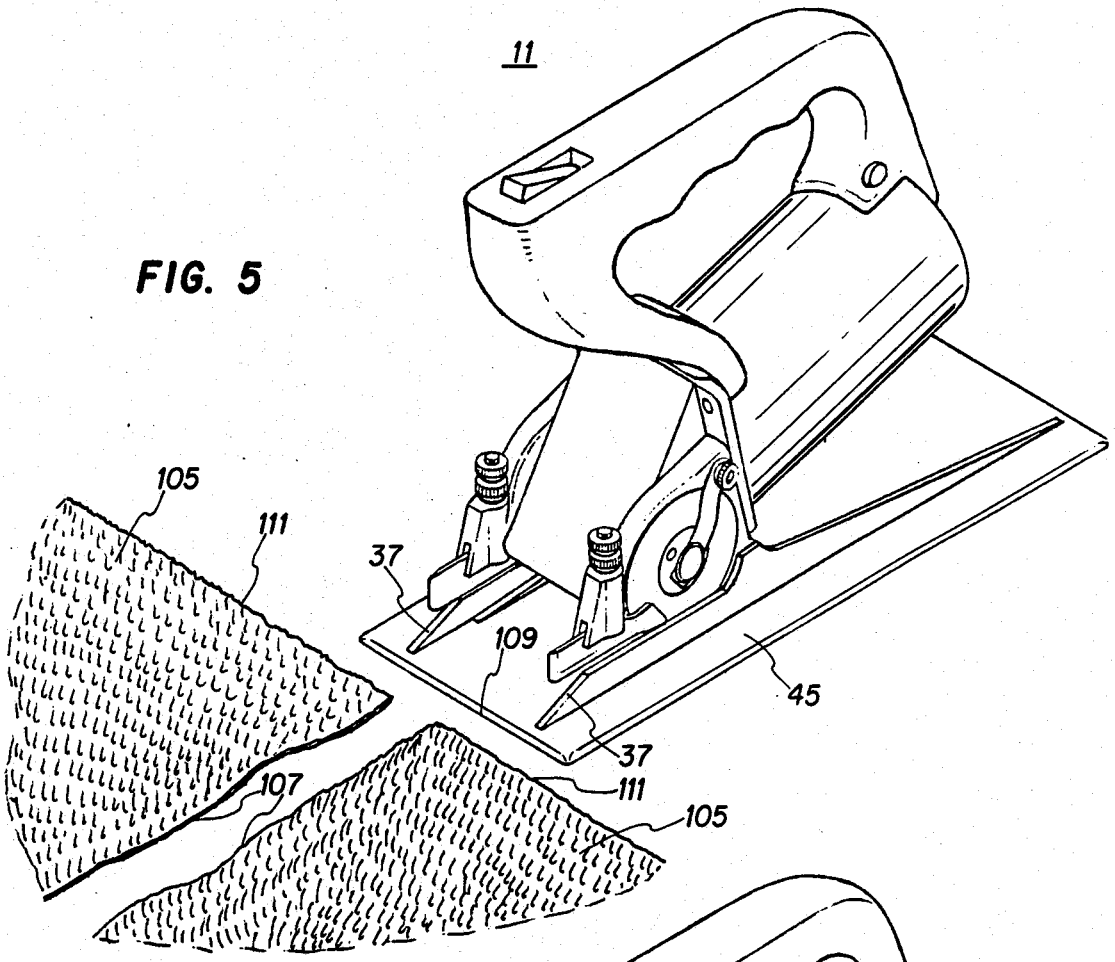
FIGS. 5, 6 and 7 are perspective views showing carpet being cut by the cutting tool of the present invention.
Figure 6:
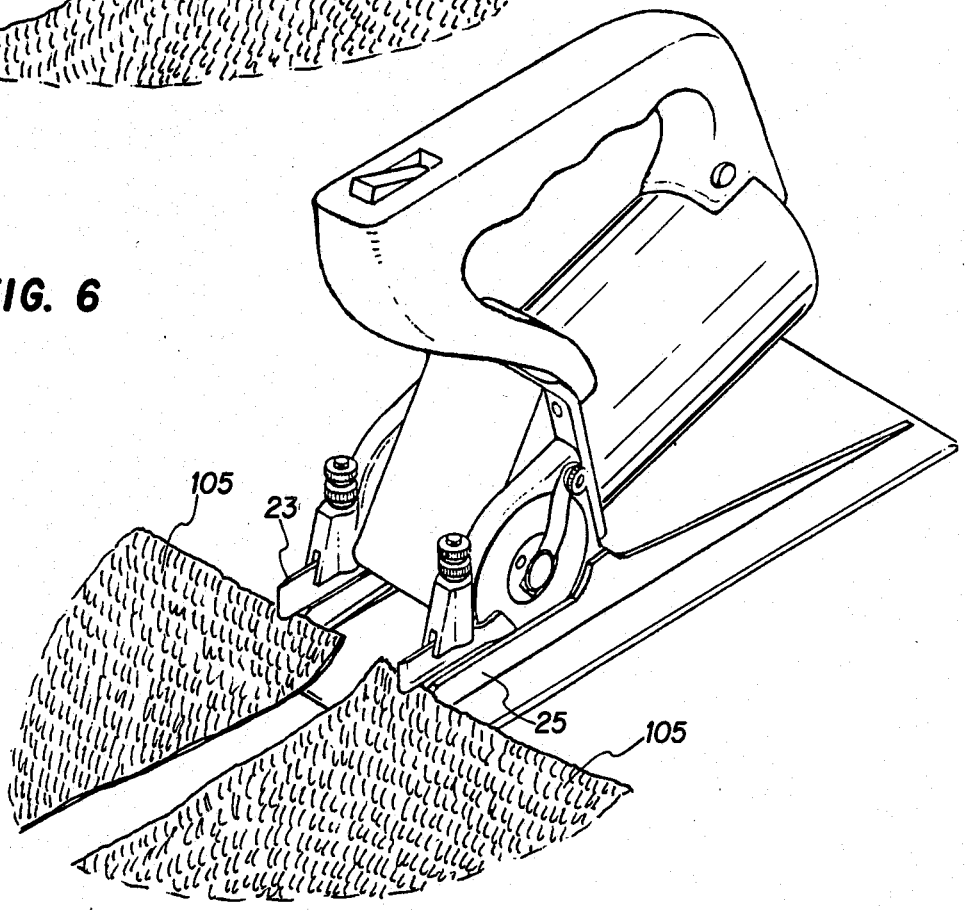
Figure 7:
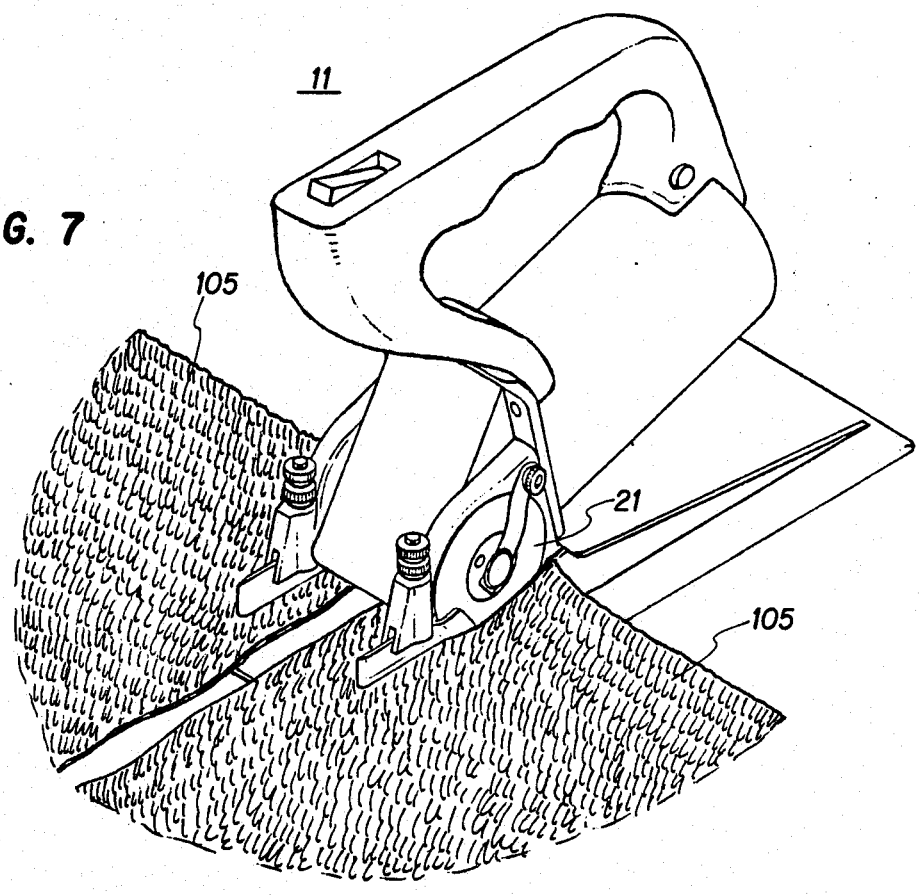

Referring to FIGS. 5, 6 and 7, cutting tool 11, as embodied in FIGS. 1-3, is shown in operation. Two pieces of carpet 105 which are to be joined together at a seam are laid side by side with the irregularly shaped selvage edges 107 adjacent to one another. Cutting tool 11 is positioned in front of the two pieces of carpet 105 so that the front edge 109 of base member 45 is substantially parallel to the respective front edges 111 of carpet 105.

The cutting process begins, as shown in FIG. 6, by advancing cutting tool 11 toward the pieces of carpet 105 so that front edges 111 of carpet 105 overlap front edge 109 of base member 45 and are lifted up by inclined portion 37 of second guide member 25.

As shown in FIG. 7, the operator of cutting tool 11 continues to advance cutting tool 11 along carpet 105 so that carpet 105 is received within channel 35 between first guide member 23 and second guide member 25. Guide members 23 and 25 hold carpet 105 in the proper alignment and position for optimum cutting by blades 21. Second guide member 25 cooperates with the corresponding blade 21 to provide a "shear cutting" action on carpet 105 in much the same manner that a pair of ordinary scissors cuts a piece of paper or the like. Prior to commencing the cutting operation, the spacing between first guide member 23 and second guide member 25 is adjusted in the manner described with reference to FIG. 3 above so that carpet 105 fits snugly between guide members 23 and 25 to achieve the proper tension for optimum cutting, while allowing sufficient spacing for carpet 105 to move freely through channel 35 without unnecessary friction or binding.

The result of the cutting operation depicted in FIGS. 5, 6 and 7 is a smooth, continuous cut along the irregular edges of two pieces of carpet 105 to yield substantially parallel, matching edges, which can be readily joined together to form a carpet seam. The spring-loaded adjustment mechanism, as described with reference to FIG. 3, allows the spacing between guide members 23 and 25 to be temporarily increased in response to variations in the thickness of carpet 105 so that carpet 105 does not "hang up" between guide members 23 and 25 if an area of irregular or increased thickness is temporarily encountered. The use of parallel cutting blades allows a user to make parallel cuts in two pieces of carpet in a single step process, which is substantially faster and more accurate than attempting to cut parallel edges in a two-step process using a single blade carpet cutter.

Various embodiments of the invention have now been described in detail. Since changes in and modifications to the above-described embodiments may be made without departing from the nature, spirit and scope of the invention, the invention is not to be limited to said details, except as set forth in the appended claims.

What is claimed is:

1. A tool for cutting materials such as carpet material and the like, comprising:

a housing comprised of an electrically non-conductive material;

a pair of rotatable cutting blades disposed at selected positions on respective opposite sides of said housing in substantially parallel relationship with one another;

guide means attached to said housing adjacent to each of said cutting blades for maintaining the material to be cut in a selected position with respect to said cutting blades, each of said guide means having first and second guide members, said second guide member being substantially in registration with said first guide member for receiving the material to be cut in an opening between said first and second guide members;

adjustment means disposed on said housing adjacent to each of said blades for adjusting the size of said opening between said first and second guide members in accordance with the thickness of the material to be cut; and means for rotating said cutting blades at the desired speed for cutting.

2. The tool according to claim 1 wherein each of said adjustment means is comprised of an adjustment member having a threaded portion for engaging a corresponding threaded portion within said housing, said adjustment member being movable along a vertical axis and being coupled to said first guide member for moving said guide member along said vertical axis in accordance with the movement of said adjustment member.

3. The tool according to claim 2 wherein at least a portion of said adjustment member extends outwardly from said housing and has first and second threaded nut members disposed thereon for mating with the corresponding threaded portion of said adjustment member, said first nut member for contacting said housing to secure said adjustment member and first guide member at a predetermined position to provide a desired spacing between said first and second guide members in accordance with the thickness of the material to be cut, said second nut member being disposed above said first nut member on the threaded portion of said adjustment member for locking said first nut member in a desired fixed position with respect to said adjustment member.

4. The tool according to claim 3 wherein said adjustment member is comprised of an elongated bit member having an end portion of substantially greater width than the width of the remainder of said bit member, said end portion being received within a chamber in said first guide member to secure said first guide member to said housing.

5. The tool according to claim 1 wherein said adjustment means is comprised of an adjustment member coupled to said first guide member, said adjustment member being movable along a vertical axis for moving said first guide member along with said adjustment member to adjust the spacing between said first and second guide members, said adjustment member having a threaded portion which extends at least partially outwardly from said housing;

a spring member mounted on said adjustment member within said housing for biasing said adjustment member and said first guide member toward said second guide member and permitting said adjustment member and said first guide member to move along said vertical axis away from said second guide member to allow the spacing between said first and second guide members to be temporarily increased in response to changes in the thickness of the material being cut;

a first threaded nut member disposed on said adjustment member for mating with the corresponding threaded portion of said adjustment member for contacting the outer surface of said housing to limit the movement of said adjustment member and said first guide member along said vertical axis towards said second guide member; and a second threaded nut member disposed above said first nut member on said adjustment member for locking said first nut member in a desired fixed position on said adjustment member.

6. The tool according to claim 5 wherein said adjustment member is comprised of an elongated bit member having an end portion of substantially greater width than the width of the remainder of said bit member, said end portion being received within a chamber in said first guide member to secure said first guide member to said housing.

7. The tool according to claim 1 wherein said first guide means is comprised of a relatively flat, elongated member having a major plane which is substantially in alignment with a vertical axis between said first and second guide members, one end of said first guide member having first and second projection members forming a forked member with an opening between said first and second projection members for receiving a front portion of the corresponding blade member therebetween.

8. The tool according to claim 7 wherein said second guide member is comprised of a first portion which is inclined with respect to a bottom edge of said first guide member for lifting the material to be cut to a desired position with respect to the corresponding cutting blade and a second portion having the top edge which is substantially parallel to the bottom edge of said first guide member.

9. The tool according to claim 8 further including a relatively flat base member, both of said second guide members being attached to said base member on respective opposite sides of said housing for mounting said housing on said base member.

10. A carpet cutting tool comprising:

a housing comprised of an electrically non-conductive material;

a pair of rotatable cutting blades disposed at selected positions on respective opposite sides of said housing in substantially parallel relationship with respect to one another;

means disposed within said housing for rotating said cutting blades at the desired speed for cutting;

a base member on which said housing is mounted;

guide means disposed adjacent to each of said cutting blades for maintaining the carpet to be cut in a desired relationship with respect to the respective cutting blades, each of said guide means being comprised of first and second guide members spaced apart for receiving the carpet to be cut therebetween, each of said second guide members being substantially in registration with the corresponding first guide member and cooperating with the corresponding first guide member and cutting blade to provide a shear cutting action on the carpet to be cut;

means for adjusting the spacing between the corresponding first and second guide members in accordance with the thickness of the carpet to be cut, said adjustment means being comprised of a member movable along a vertical axis substantially orthogonal to the major plane of said base member, a first portion of said bit member being disposed within said housing and being coupled to said first guide member for moving said first guide member along said vertical axis and a second portion of said bit member being threaded and extending outwardly from said housing along said vertical axis;

a spring member disposed on said bit member within said housing for biasing said bit member and said first guide member towards said second guide member and for permitting said bit member and said first guide member to move against the bias of said spring member away from said second guide member to allow the spacing between said first and second guide members to be temporarily increased in response to variations in the thickness of the carpet being cut;

a first threaded nut member disposed on said second portion of said bit member for contacting an outer surface of said housing to limit the downward movement of said bit member and said first guide member toward said second guide member, said first nut member being movable along the major axis of said bit member in either direction in accordance with the direction of rotation of said nut member; and a second threaded nut member disposed above said first nut member on said bit member for locking said first nut member in a desired fixed position with respect to said bit member.

11. The cutting tool according to claim 10 wherein said bit member includes an end portion of substantially greater width than the width of the remainder of said bit member, said end portion being received within a chamber disposed in said first guide member to couple said first guide member to said housing.

12. The cutting tool according to claim 11 wherein the portion of said housing in which said bit member is disposed includes an opening for receiving said bit member, said spring member and an upper portion of said first guide member, said spring member extending along said bit member substantially between a top surface of said upper portion of said first guide member and an inner surface of said housing above said opening, the upward movement of said bit member and said first guide member away from said second guide member being arrested when said top surface of said upper portion of said first guide member contacts said top inner surface of said housing.

13. The cutting tool according to claim 12 wherein said first guide member is comprised of a relatively flat member, the major plane of which is substantially orthogonal to the major plane of said base member, said first guide member having a leading edge and a trailing edge, said trailing edge having first and second projection members extending outwardly therefrom to form a forked member for receiving a front portion of the corresponding cutting blade between said first and second projection members to protect and align the corresponding cutting blade during operation thereof and a bottom edge which is in substantial registration with the corresponding second guide member.

14. The cutting tool according to claim 13 wherein said second guide member is comprised of a first portion which is inclined with respect to the base member and the bottom edge of said first guide member for lifting the carpet material and guiding it toward the corresponding cutting blade and a second portion having an upper surface which is substantially parallel to at least a portion of the bottom edge of said first guide member.

15. A carpet cutting tool comprising:

a housing comprised of an electrically non-conductive material;

a pair of rotatable cutting blades disposed at selected positions on respective opposite sides of said housing in substantially parallel relationship with respect to one another;

means disposed within said housing for rotating said cutting blades at the desired speed for cutting;

a base member on which said housing is mounted;

guide means disposed adjacent to each of said cutting blades for maintaining the carpet to be cut in a desired relationship with respect to the respective cutting blades, each of said guide means being comprised of first and second guide members spaced apart for receiving the carpet to be cut therebetween, each of said second guide members being substantially in registration with the corresponding first guide member and cooperating with the corresponding first guide member and cutting blade to provide a shear cutting action on the carpet to be cut; and means for adjusting the spacing between said first and second guide members, comprising a bit member, the major axis of which is substantially orthogonal to the major plane of said base member, said bit member being coupled to said first guide member and having a threaded portion which is disposed partially within and partially without said housing, said housing having a threaded section for engaging the corresponding threaded portion of said bit member, said bit member being movable along the major axis thereof in either direction by rotating said bit member in a desired direction of rotation, said bit member being coupled to the corresonding first guide member for moving said first guide member with said bit member along the major axis of said bit member to adjust the spacing between said first and second guide members as desired;

a first nut member which is threadedly mounted on the threaded portion of said bit member outside of said housing to facilitate the rotation of said bit member and being movable with respect to said bit member for contacting an outer surface of said housing to secure said bit member and said first guide member in a desired position with respect to said second guide member; and a second nut member disposed above said first nut member on said bit member for locking said first nut member in a desired fixed position with respect to said bit member.

16. The cutting tool according to claim 15 wherein said bit member has an end portion of substantially greater width than the width of the remainder of said bit member and said first guide member has a recessed chamber in which said end portion of said bit member is disposed to couple said first guide member to said bit member and to said housing.

* * * * *